US006896733B2

(12) United States Patent
Schiele

(10) Patent No.: US 6,896,733 B2
(45) Date of Patent: May 24, 2005

(54) COATING DEVICE FOR AN ELONGATED WORKPIECE

(75) Inventor: Stefan Schiele, Niederzissen (DE)

(73) Assignee: Josef Schiele oHG, Niederzissen (DE)

( * ) Notice: Subject to any disclaimer, the term of this patent is extended or adjusted under 35 U.S.C. 154(b) by 0 days.

(21) Appl. No.: 10/469,823

(22) PCT Filed: Jan. 23, 2002

(86) PCT No.: PCT/EP02/00625

§ 371 (c)(1),
(2), (4) Date: Jan. 16, 2004

(87) PCT Pub. No.: WO02/072279

PCT Pub. Date: Sep. 19, 2002

(65) Prior Publication Data

US 2004/0112281 A1 Jun. 17, 2004

(30) Foreign Application Priority Data

Mar. 7, 2001 (DE) ..... 101 10 859

(51) Int. Cl.[7] ..... B05C 15/00
(52) U.S. Cl. ..... 118/50; 118/326
(58) Field of Search ..... 118/50, 326, 715, 118/723 VE, 726; 427/294, 295, 296, 297, 298; 55/288, DIG. 46

(56) References Cited

U.S. PATENT DOCUMENTS 3,992,177 A * 11/1976 Welteroth ..... 55/288
4,473,428 A * 9/1984 Buck et al. ..... 156/474
5,078,080 A 1/1992 Schiele

FOREIGN PATENT DOCUMENTS

DE 3632405 4/1987
EP 0830887 3/1998

* cited by examiner

*Primary Examiner*—Laura Edwards
(74) *Attorney, Agent, or Firm*—Friedrich Kueffner

(57) ABSTRACT

A device for applying a coating medium to at least one partial surface of an elongated workpiece in a vacuum chamber. The device includes a housing (1) having a storage container (2) with an oblique base (3) and an air conduit opening into the base and of a deposition device that is positioned above the storage container. To ensure that the air stream exiting the vacuum chamber has a degree of purity that complies with legal requirements so that the stream can also be introduced into the working chamber, or can be used for a further coating process without any detrimental effect on the same, several sheath-type filter rods (13), which consist of borosilicate glass and are traversed by the air, are arranged downstream of the deposition device (5,7) in the direction of flow of the air removed by suction.

6 Claims, 1 Drawing Sheet

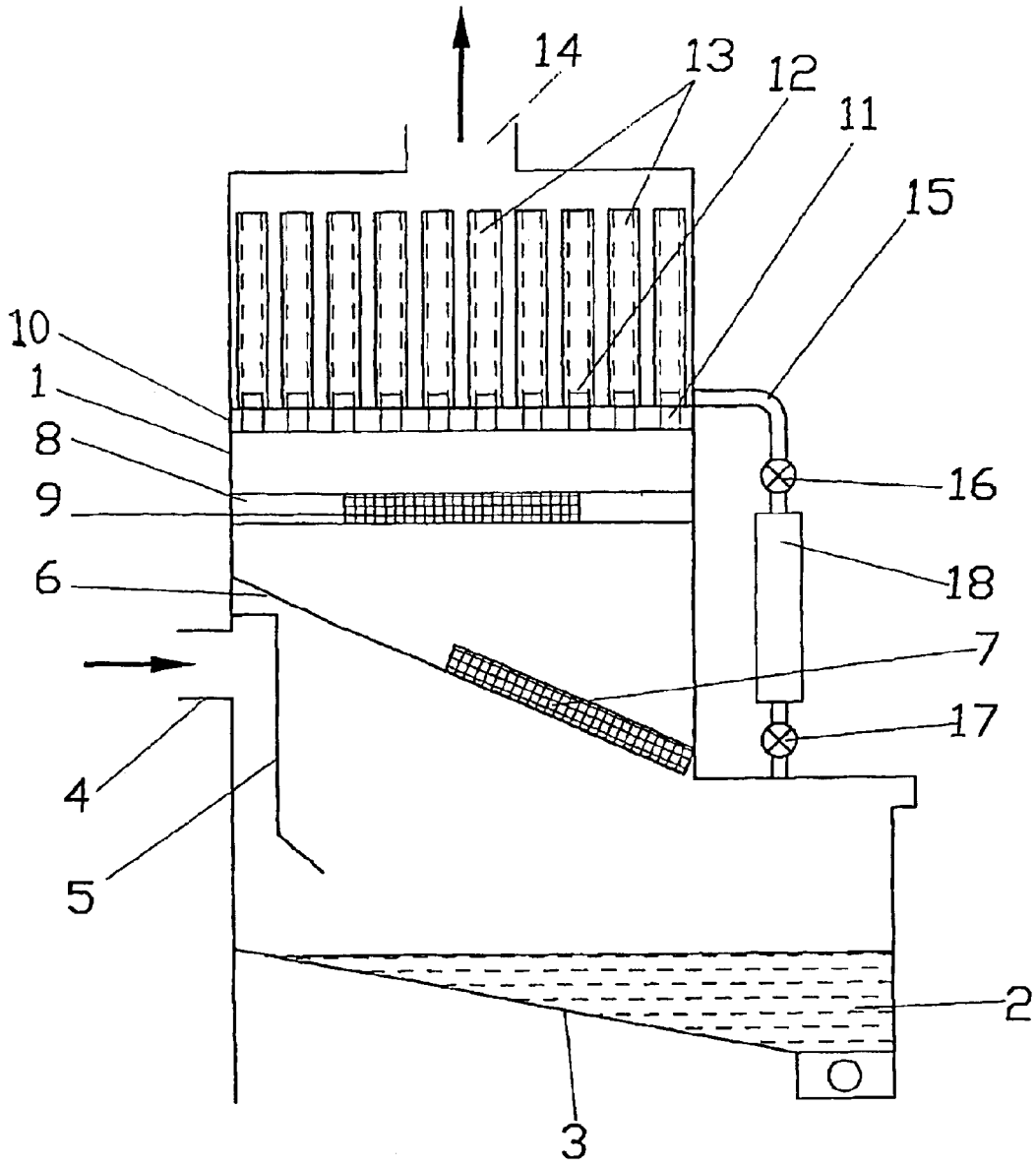
14
13
12
11
15
10
1
8
9
16
6
18
7
17
4
5
2
3

COATING DEVICE FOR AN ELONGATED WORKPIECE

BACKGROUND OF THE INVENTION

1. Field of the Invention

The invention relates to a device for applying a coating medium to at least one partial surface of an elongated workpiece in a vacuum chamber, said device consisting of a housing with a reservoir having an oblique bottom and of an air line issuing into said reservoir and also of a separation means located above the reservoir.

2. Description of the Related Art

It is known to provide elongated workpieces, transported in their longitudinal direction, with a coating medium at least on part of their surface. In this case, the workpieces often consist of wood or wood-containing materials. The coating media used are pumpable and filterable nozzle-compatible liquids, such as pigment solutions, dyes, lacquers and priming and impregnating agents. This coating medium is located in a reservoir which is mostly formed in the lower region of a housing and has an oblique bottom. The coating medium is conveyed from this reservoir to an application unit which is designed as a spraying or flooding frame or as a slit nozzle, depending on the profile or independently of the profile. This application unit is formed in what is known as a vacuum chamber which is connected to a vacuum tank. A stream of finely atomized coating medium and air is formed in this vacuum chamber, the air being sucked in from outside via narrow gaps surrounding the workpiece. The workpiece to be coated is then fed through this stream of finely atomized coating medium and air. In this case, on the one hand, what is known as interstitial air is extracted from the workpiece and, on the other hand, the coating medium settles intensively on the intended surfaces of the workpiece. Excess coating medium is sucked away from the vacuum chamber together with the air and is returned into the housing having the reservoir. Through an orifice located above the reservoir, the air stream laden with excess coating medium enters the housing and impinges there onto a baffle plate likewise inserted above the reservoir. Here, the air stream is first deflected downward, before it is sucked away upward into the vacuum tank via a perforated plate or the like. During this deflection of the air stream, particles of the coating medium are separated as drops and fall down onto the oblique bottom or into the reservoir. The baffle plate and the perforated plate together are therefore also referred to as a separation means. From here, the coating medium is pumped once again to the application unit in the vacuum chamber. For example, when the coating medium contains oil or oil-containing constituents, an oil mist is located in the air sucked away from the vacuum chamber and reentering the housing above the reservoir and, during deflection by the baffle plate and passage through the perforated plate, cannot be removed or cannot be removed completely. This oil mist may be detrimental to the further coating operation. If the air sucked away from the vacuum chamber is not returned into the vacuum tank, but is led into the working space, the quality of the room air is considerably impaired.

SUMMARY OF THE INVENTION

The object on which the invention is based is therefore to design a device for applying a coating medium to at least one partial surface of an elongated workpiece, in such a way that the air stream flowing out of the vacuum chamber is treated, before it once again enters the vacuum tank or the working space, in such a way that the air stream has a degree of purity which corresponds to the statutory conditions, so that, on the one hand, the coating operation is not impaired and, on the other hand, the spent air can also be introduced, as required, into the working space.

To achieve this object, according to the invention, in a device of the generic type described initially, it is proposed that a plurality of sleeve-like filter rods through which the air flows and which consist of borosilicate glass be arranged downstream of the separation means in the direction of flow of the air sucked away from the vacuum chamber.

By virtue of this design, over 99% of the oil mist contained in the spent-air stream is filtered out and recovered. The consumption of coating medium can consequently be reduced. The spent air reaches such a high degree of purity that it can also be discharged into the working space without difficulty.

BRIEF DESCRIPTION OF THE DRAWING

The invention is explained in more detail below with reference to an exemplary embodiment illustrated in a drawing.

DESCRIPTION OF THE PREFERRED EMBODIMENTS

Of a device for applying a coating medium to at least one partial surface of an elongated workpiece transported in its longitudinal direction, this drawing shows only a housing 1 which in its lower region possesses a reservoir 2 with an oblique bottom 3 for receiving the coating medium. Above the reservoir 2, the housing 1 has an orifice 4, via which air can flow into the lower region of the housing 1. This air comes from a vacuum chamber, in which a coating medium is applied to elongated workpieces on at least part of the surface. The air sucked away from the vacuum chamber and flowing into the housing 1 via the orifice 4 thus contains finely atomized coating medium and, under some circumstances, also dust. This dust may pass into the air stream due to the fact that air is also sucked in because of the vacuum in the vacuum chamber.

Located in the housing 1 at a short distance behind the orifice 4 is what is known as a baffle plate 5 which is directed downward in the direction of the reservoir 2 and deflects the in flowing air downward. Above the reservoir 2 and the baffle plate 5 is provided an inclined intermediate plate 6, into which a perforated plate 7 consisting, for example, of high-grade steel is inserted. Above the intermediate plate 6 is located a first intermediate bottom 8, into which an exchangeable and, for example, regenerative air filter 9 is inserted. Located at a distance above the first intermediate bottom 8 is a second intermediate bottom 10 which is provided with a multiplicity of orifices 11. Each orifice 11 is surrounded by a short tubular connection piece 12 which itself serves for receiving a sleeve-like filter rod 13. Each filter rod 13 is advantageously of two-layer design and consists of an inner fine-mesh collecting layer and of an outer coarse-mesh drainage layer which consists of borosilicate glass fibers. The sleeve-like filter rods 13 are designed so as to be closed at their end facing away from the second intermediate bottom 10, that is to say at the top. The housing 1 terminates above the filter rods 13 and merges into an orifice 14, to which, for example, a vacuum line may be connected.

The air stream entering the lower region of the housing 1 via the orifice 4, then, is first deflected downward by the baffle plate 5 before it flows upward again through the perforated plate 7. Consequently, on the one hand, the air stream is deflected, while, on the other hand, the air is expanded, this necessarily entailing a reduction in the flow velocity of the air. As a result, particles of the coating medium which are present in the air which has entered are separated directly and pass into the reservoir 2 again. The air then flows through the dust filter 9. In this case, dust particles possibly contained in the air are filtered out. The air filter 9 is either exchanged as an exchangeable filter and can be renewed. It is also possible, however, to use a regenerative and therefore multiply usable filter.

The air flowing upward through the dust filter 9 of the intermediate bottom 8 then passes into the orifices 11 of the second intermediate bottom 10 and then flows through the sleeve-like filter rods 13 consisting of borosilicate glass fibers. In this case, the inner layer of the sleeve-like filter rods functions as what is known as a fine-mesh collecting layer for an oil mist possibly contained in the air and consisting, for example, of aerosol particles. These aerosol particles coalesce on the fine glass fiber filaments of the inner layer to form larger droplets and are discharged outward through the outer coarse-mesh drainage layer. These droplets are combined here into larger liquid drops which then flow downward as a result of gravity and are collected by the intermediate bottom 10 which acts as a collecting means. The oily liquid collecting on the intermediate bottom 10 may be collected in a container 18, for example via a line 15 having valves 16, 17. The liquid collected here may, as required, be treated or be returned directly into the reservoir 2. A cellular wheel sluice may alternatively also be used here.

In a modification of the exemplary embodiment explained, it is possible to arrange the sleeve-like filter rods 13 consisting of borosilicate glass directly behind or above the perforated plate 7. The first intermediate bottom 8 having the dust filter 9 is then dispensed with. Furthermore, it is possible to arrange the filter rods 13 consisting of borosilicate glass in a separate housing. Moreover, it is possible to arrange the dust filter 9 and the filter rods 10 downstream of a differently constructed separation system.

What is claimed is:

1. A device for applying a coating medium in a vacuum chamber to at least one partial surface of an elongated workpiece, said device comprising a housing with a reservoir having an oblique bottom, an air line issuing into said reservoir, and a separation means located above the reservoir, wherein a plurality of sleeve-like filter rods through which the air flows and which consist of borosilicate glass are arranged downstream of the separation means (5, 7) in a direction of flow of air sucked away from the vacuum chamber.

2. The device as claimed in claim 1, wherein the filter rods (13) are closed at their end facing away from the inflow end.

3. The device as claimed in claim 1 wherein the filter rods (13) are arranged vertically and are designed to be capable of being plugged on.

4. The device as claimed in claim 1, wherein the filter rods (13) are of two-layer design and consist of an inner fine-mesh collecting layer and of an outer coarse-mesh drainage layer.

5. The device as claimed in claim 1, wherein the filter rods (13) are assigned a collecting means (10) having an outlet line (15).

6. The device as claimed in claim 1, wherein a dust filter (9) is arranged between the separation means (5, 7) and the filter rods (13).

* * * * *